US011891202B2

(12) United States Patent
Rehn et al.

(10) Patent No.: US 11,891,202 B2
(45) Date of Patent: Feb. 6, 2024

(54) UNWINDING A FILM ROLL IN A PACKAGING MACHINE

(71) Applicant: GEA Food Solutions Germany GmbH, Biedenkopf-Wallau (DE)

(72) Inventors: Jochen Rehn, Biedenkopf-Wallau (DE); Frank Sabato, Biedenkopf (DE)

(73) Assignee: GEA Food Solutions Germany GmbH, Biedenkopf-Wallau (DE)

( * ) Notice: Subject to any disclaimer, the term of this patent is extended or adjusted under 35 U.S.C. 154(b) by 0 days.

(21) Appl. No.: 17/055,217

(22) PCT Filed: May 20, 2019

(86) PCT No.: PCT/EP2019/062937

§ 371 (c)(1),
(2) Date: Nov. 13, 2020

(87) PCT Pub. No.: WO2019/219966

PCT Pub. Date: Nov. 21, 2019

(65) Prior Publication Data

US 2021/0214110 A1 Jul. 15, 2021

(30) Foreign Application Priority Data

May 18, 2018 (DE) ..... 10 2018 207 924.2
Oct. 30, 2018 (DE) ..... 10 2018 218 582.4

(51) Int. Cl.
*B65B 41/16* (2006.01)
*B65B 9/04* (2006.01)
(Continued)

(52) U.S. Cl.
CPC ..... *B65B 41/16* (2013.01); *B65B 9/04* (2013.01); *B65B 41/18* (2013.01); *B65B 57/04* (2013.01);
(Continued)

(58) Field of Classification Search
CPC ..... B65B 9/04; B65B 11/52; B65B 47/00–47/10; B65B 41/16; B65B 41/18;
(Continued)

(56) References Cited

U.S. PATENT DOCUMENTS 3,762,125 A * 10/1973 Prena ..... B65B 7/164 226/27
3,965,656 A * 6/1976 Gerben ..... B65B 61/28 53/329.4
(Continued)

FOREIGN PATENT DOCUMENTS

CN 202186781 U 4/2012
CN 103193102 A 7/2013
(Continued)

OTHER PUBLICATIONS

Chinese First Office Action dated Dec. 24, 2021, for Chinese patent application No. 2019800333481.
(Continued)

*Primary Examiner* — Dariush Seif
(74) *Attorney, Agent, or Firm* — Dobrusin Law Firm, P.C.

(57) ABSTRACT

A packaging machine which unwinds a bottom film web from a supply roll and conveys it intermittently or continuously along the packaging machine and in a forming station, forms into the bottom film web packaging cavities, which are then filled with a product to be packaged. In a sealing station, a top film web is sealed to the bottom film web, wherein the bottom and top film web are respectively unwound from a supply roll and the bottom and top film web are respectively tensioned by means of a dancer roll. The supply roll is driven by means of a motor, the parameters of which, in particular rotation speed and/or torque, can be set on the basis of the parameters of the respective supply roll.

21 Claims, 3 Drawing Sheets

(51) Int. Cl.
*B65B 41/18* (2006.01)
*B65B 57/04* (2006.01)
*B65H 16/00* (2006.01)
*B65H 23/18* (2006.01)

(52) U.S. Cl.
CPC ..... *B65H 16/005* (2013.01); *B65H 23/1806* (2013.01)

(58) Field of Classification Search
CPC ..... B65B 57/04; B65H 16/005; B65H 23/04–34; B65H 23/1806
USPC ..... 53/64, 453, 559, 561, 329.2–329.4
See application file for complete search history.

(56) References Cited

U.S. PATENT DOCUMENTS 3,979,877 A * 9/1976 Vetter ..... B65B 9/04 53/51
4,054,251 A * 10/1977 Henderson ..... B65H 23/0326 226/15
4,200,481 A * 4/1980 Faller ..... B29C 51/165 156/499
4,691,499 A 9/1987 Umeda et al.
4,833,862 A * 5/1989 Bortolani ..... B65D 75/305 426/396
4,996,819 A * 3/1991 Davis ..... B65B 9/023 53/64
5,163,269 A * 11/1992 Williams ..... B65D 77/2024 53/412
5,170,611 A * 12/1992 Buchko ..... B26D 7/2614 53/579
5,176,334 A * 1/1993 Dreschau ..... B65H 23/16 242/413.3
5,558,263 A * 9/1996 Long ..... B65H 23/035 226/114
6,033,502 A * 3/2000 Coenen ..... A61F 13/15772 226/29
6,138,439 A * 10/2000 McMahon ..... B65B 9/04 53/139.2
6,820,394 B2 * 11/2004 Plourde ..... B65B 61/188 53/133.4
6,820,399 B2 * 11/2004 Send ..... B65B 41/12 53/64
6,826,888 B2 * 12/2004 Hendriks ..... B65B 41/16 53/139.2
6,843,038 B1 * 1/2005 Haws ..... B65B 61/188 53/553
6,868,654 B2 * 3/2005 Douglas ..... B65B 61/188 53/511
8,474,226 B2 * 7/2013 Izquierdo ..... B65B 57/10 493/15
10,065,755 B2 * 9/2018 Palumbo ..... B65B 31/021
11,117,771 B2 * 9/2021 Hada ..... B65H 23/26
11,174,050 B2 * 11/2021 Palumbo ..... B65B 7/164
2002/0184858 A1 * 12/2002 Ausnit ..... B65B 61/188 53/450
2004/0123568 A1 * 7/2004 Send ..... B65B 41/18 53/64
2005/0247020 A1 * 11/2005 Niesar ..... B65B 59/04 52/750
2005/0284109 A1 * 12/2005 Jones ..... B65B 11/00 53/461
2006/0093794 A1 * 5/2006 Yukawa ..... B65B 47/04 156/352
2006/0230708 A1 * 10/2006 Granili ..... B65B 9/045 53/427
2008/0034710 A1 * 2/2008 Ehrmann ..... B65B 9/04 53/389.2
2009/0152261 A1 * 6/2009 Capriotti ..... B29C 66/53461 219/635
2010/0011718 A1 * 1/2010 Donges ..... B65B 65/00 53/329.2
2010/0287881 A1 * 11/2010 Ehrmann ..... B65B 31/028 53/329.2
2011/0017860 A1 * 1/2011 Vaughn ..... B65H 19/2223 242/522
2011/0061344 A1 * 3/2011 Ehrmann ..... B29C 51/422 53/561
2012/0199685 A1 * 8/2012 Weiss ..... B65H 18/106 242/415
2012/0289388 A1 * 11/2012 Ehrmann ..... B29C 51/082 483/1
2013/0248411 A1 * 9/2013 Bader ..... B65B 61/02 206/557
2014/0018220 A1 * 1/2014 Wilhelm ..... B65B 31/021 493/121
2014/0150377 A1 * 6/2014 Ehrmann ..... B65B 47/02 53/559
2014/0249007 A1 * 9/2014 Ehrmann ..... B65B 41/14 493/102
2015/0033679 A1 2/2015 Takahashi et al.
2015/0096263 A1 * 4/2015 Ehrmann ..... B65B 61/025 53/411
2015/0102152 A1 * 4/2015 Duehring ..... B65H 23/048 242/419.1
2015/0104563 A1 * 4/2015 Lowe ..... G01B 11/22 250/341.1
2015/0135650 A1 * 5/2015 Lau ..... B65B 59/003 53/561
2015/0185673 A1 * 7/2015 Atay ..... H04N 1/00037 399/389
2015/0203223 A1 * 7/2015 Ehrmann ..... B65B 7/164 493/52
2015/0229845 A1 * 8/2015 Duss ..... B65H 11/007 348/207.11
2016/0068292 A1 * 3/2016 Fries ..... B65B 25/06 137/561 R
2016/0177983 A1 * 6/2016 Ehrmann ..... F15B 15/2892 92/5 R
2016/0187484 A1 * 6/2016 Bloomfield ..... H01S 5/3013 250/341.8
2016/0194101 A1 * 7/2016 Palumbo ..... B65B 9/04 53/511
2016/0280440 A1 * 9/2016 von Sybel ..... B65B 61/28
2017/0029141 A1 * 2/2017 Cherney ..... B65B 57/00
2017/0029150 A1 * 2/2017 Ehrmann ..... B65B 9/04
2017/0107070 A1 * 4/2017 Franke ..... B65H 20/02
2017/0113825 A1 * 4/2017 Naoi ..... B65B 51/30
2017/0253451 A1 * 9/2017 Kito ..... B65H 20/24
2017/0327257 A1 * 11/2017 Sabato ..... B65B 65/02
2018/0110579 A1 * 4/2018 Kalyankar ..... B65B 5/02
2018/0186484 A1 * 7/2018 Kikuchi ..... B65B 41/12
2018/0222619 A1 * 8/2018 Ehrmann ..... B29C 65/18
2019/0061301 A1 * 2/2019 Öhman ..... B65H 37/00

FOREIGN PATENT DOCUMENTS

CN 103935811 A 7/2014
DE 19516870 A1 11/1996
DE 102014211786 A1 12/2015
EP 0067481 A2 12/1982
EP 0872419 A1 10/1998
EP 2163499 A1 3/2010
GB 1296251 A 11/1972
GB 1451662 A 10/1976
JP 2014031226 A 2/2014
WO 2017/002915 A1 1/2017

OTHER PUBLICATIONS

English Translation of the International Preliminary Report on Patentability for International Application PCT/EP2019/062937, dated Oct. 22, 2020.
International Search Report and Written Opinion for International Application PCT/EP2019/062937, dated Sep. 6, 2019.

(56) References Cited

OTHER PUBLICATIONS

Office Action from CN Application No. 201980033348.1, dated Sep. 5, 2022.

* cited by examiner

UNWINDING A FILM ROLL IN A PACKAGING MACHINE

FIELD

The present invention relates to a packaging machine and to a method for producing a packaging.

BACKGROUND

Packaging machines of this type are known from the prior art. In these packaging machines, a bottom film web is unwound from a supply roll and conveyed, preferably intermittently, along the packaging machine. In a forming station, there is formed into the bottom film web a packaging cavity, which is subsequently filled with a product to be packaged, in particular a food product. After this, the packaging cavity is closed off in a sealing station with a top film, which is sealed to the bottom film. The film web is here likewise unwound from a supply roll. Between the supply roll and the sealing station is here provided a dancer roll, which has to be adapted to the initial draw which the bottom film web makes in one feed.

For instance, WO 2012/116823 discloses packaging machines in which a bottom film web is unwound from a supply roll and is conveyed, preferably intermittently, along the packaging machine. In a forming station there is firstly formed into the bottom film web a packaging cavity, which is subsequently filled with a product to be packaged, in particular a food product. After this, the packaging cavity is closed off in a sealing station with a top film, which is sealed to the bottom film. The film web is here likewise unwound from a supply roll. Between the supply roll and the sealing station is here provided a dancer roll, which has to be adapted to the initial draw which the bottom film web makes in one feed. For this, a dancer roll which was individually designed for the packaging machine had formerly to be provided, which proved to be very costly. Moreover, the material web tension was subject to inherent fluctuations, which could be detrimental. The unwinding motion of the films was preferably generated by the feed of the packaging machine and the tensioning force, generated by the dancer roll, in the film.

WO 2016087169 A1 teaches an improved version with rotational dancer roll, wherein the top film web is unwound from a supply roll, and downstream of the supply roll is provided a dancer roll which preferably has two rolls provided on a linkage that, driven by a rotary drive, rotates about a rotation axis and thereby stores a certain length of film web and/or generates a desired tension in the film web.

SUMMARY

It was therefore the object of the present invention to provide a packaging machine having a dancer roll, and a method for producing a packaging, the range of application of which is markedly widened and/or tensions in the respective film web are markedly reduced.

The object is achieved with a packaging machine which unwinds a bottom film web from a supply roll and conveys it intermittently or continuously along the packaging machine and herein, in a forming station, forms into the bottom film web packaging cavities, which are then filled with a product to be packaged, wherein subsequently, in a sealing station, a top film web is sealed to the bottom film web, wherein the bottom and top film web are respectively unwound from a supply roll and the bottom and top film web are respectively tensioned by means of a dancer roll, wherein the supply roll is driven by means of a motor, the parameters of which, in particular rotation speed and/or torque, can be set on the basis of the parameters of the respective supply roll.

The comments made regarding this subject of the present invention apply equally to the other subjects of the present invention, and vice versa. Features which have been disclosed in relation to this subject of the present invention can be incorporated into the other subjects.

The present invention relates to a packaging machine in which a bottom film web, in particular a plastics film web, which preferably has a width between 200 mm and 1 m and more, is unwound from a supply roll and is conveyed, preferably intermittently/in cycles, along the packaging machine. In a forming station, this bottom film web is then firstly warmed and, by means of a deep-drawing tool, packaging cavities are formed into the bottom film web. Generally, a plurality of packaging cavities, which are arranged in a so-called format, are formed simultaneously and thereafter simultaneously conveyed along the packaging machine. After this, each packaging cavity is filled with a product to be packaged, in particular a food product, such as, for instance, sausage, ham or cheese, and in a next step, in a sealing station, closed off with a top film, wherein the top film is generally sealed to the bottom film web. The person skilled in the art will understand that the product to be packaged can also be filled/placed into unformed films. After this, the thus finished packaging is separated. The top film web is likewise unwound from a supply roll. In relation to the direction of transport of the respective film web, downstream of at least one supply roll is found a dancer roll, which keeps the tension in the film web at least substantially constant. The dancer roll can be constituted, for instance, by a linear or a rotational dancer roll or a pivot arm dancer roll.

The number of simultaneously produced packagings and the length or width thereof determine the length of the feed within a cycle, wherein up to 3 meters are perfectly normal.

According to the invention, at least one, preferably both, supply roll(s) are driven by means of a motor, the parameters of which, in particular rotation speed and/or torque, can be set on the basis of the parameters of the respective supply roll.

For instance, the core diameter of the roll, the film width, the film thickness, the film length, the original and/or current weight of the supply roll, the original and/or current diameter of the supply roll, and/or the specific film weight, are taken into account. On the basis of one or more of these parameters of the respective supply roll, the currently required torque or the required rotation speed is calculated and the motor is controlled/regulated accordingly, in particular in order to provide the film length required for a cycle/feed.

The packaging machine according to the invention has the advantage that very small but also very large feed lengths can be realized without the film being placed under heavy mechanical strain, for instance stretched. Feed lengths of just a few mm up to 3 meters or more can be realized without problems. The drive of the respective supply roll is preferably activated already from a feed of 0.1 mm and above. In the region of the top film and/or bottom film, a film brake, for instance for the alignment of print marks, can be dispensed with. A roll brake can also be dispensed with, since the motor itself also generates the braking effect, after which customary and unwanted abrasion produced by a previous roll brake is no longer an issue. With the packaging machine according to the invention, very thin films are able to be processed.

Preferably, the packaging machine has a means which registers the speed of the respective film web, in particular the bottom film web, preferably the speed pattern during an initial draw/feed. Alternatively or additionally, the speed or the speed pattern can be stored as data and/or a data record in a control system of the packaging machine. The speed and the speed pattern are preferably taken into account in the controlling/regulation of the drive motor of the respective supply roll.

Preferably, the motor is a servo motor or a torque motor. Preferably, the motor has a means, for instance an incremental encoder, with which the rotational position of the power take-off shaft of the motor can be registered. Preferably, the motor is a direct motor, i.e. a motor which is connected in a rotationally secure or torsion-proof manner to the shaft on which the respective supply roll is mounted. Alternatively, between the motor and the shaft on which the supply roll is mounted is provided a rigidly designed connection, for instance a toothed belt.

A torque motor is a servo motor optimized for high torques. Torque motors are usually constructed as brushless direct-current motors. Sometimes, switched reluctance motors are also, however, referred to as a torque motor.

Torque motors are external rotors (stator on the inside, rotor on the outside) or internal rotors (rotor on the inside, stator on the outside). In torque motors, external rotors are preferred, since, with these, due to the correlations represented below, a greater torque is available while the overall size remains the same. The large drive torque of torque motors allows large accelerations and leads to high dynamics of the system. Torque motors have a higher drive stiffness than traditional motor-gear units and, more preferably, no backlash. Hence better control characteristics are obtained by virtue of reduced disturbance variables and an increased repeat accuracy. In the case of large supply roll diameters, high torques, and in the case of small supply roll diameters, high rotation speeds, are required in order to drive the film roll in accordance with the initial draw speed of the packaging machine. Both can be realized with a servo and/or torque motor.

Preferably, the dancer roll, which is provided downstream of the respective supply roll, has a movement transducer, in particular a rotary encoder. The signal of this movement transducer is preferably used to regulate/control the motor. Alternatively or additionally, the signal of this movement transducer, in interaction with the incremental encoder of the drive motor of the respective supply roll, is used to determine the diameter of the supply roll, in particular the initial diameter after a change of supply roll. As a result, when the supply roll is changed, the diameter is determined automatically without having to be measured by a worker. This value is then taken into account when setting the parameters of the drive motor of the drive shaft of the supply roll. Preferably, during operation, in the course of, before or after each cycle, or after a specific number of cycles, the current diameter of the film roll is also determined and taken into account when setting of the parameters of the drives of the supply roll, in particular when setting the torque, the speed and/or the number of increments through which the drive shaft of the supply roll is meant to rotate. Preferably, the roll diameter is determined in respect of each initial draw/feed, wherein the regulation/control does not however take account of an updated value within each cycle, but more rarely, for instance only once every 3-7 cycles, and then, quite particularly preferably, forms a mean value from the measurements, for instance in order to avoid a miscalculation.

According to a preferred embodiment of the present invention, the shaft is supported at both ends, wherein a mounting is preferably provided pivotably, for instance pivotably about a vertical axis, in order to be able to easily perform a change of supply roll.

A further subject of the present invention is a packaging machine which unwinds a bottom film web from a supply roll and conveys it intermittently or continuously along the packaging machine and herein preferably, in a forming station, forms into the bottom film web packaging cavities, which are then filled with a product to be packaged, wherein subsequently, in a sealing station, a top film web is sealed to the bottom film web, wherein the bottom and top film web are respectively unwound from a supply roll and the supply roll is rotatably mounted on a shaft, wherein, as a result of the rotation, a film web is unwound in a running direction, and wherein the shaft is provided such that it is displaceable along its longitudinal center axis.

The comments made regarding this subject of the present invention apply equally to the other subjects of the present invention, and vice versa. Features which have been disclosed regarding this subject of the present invention can be incorporated into the other subjects.

Preferably, the shaft, during production, is longitudinally displaced, in particular in order to align an edge of the film web, for instance, relative to the frame of the packaging machine and/or to the film transport.

The shaft can be displaced relative to its mounting, and/or the mounting relative to the frame of the packaging machine.

Preferably, the adjustment of the shaft is realized by a servo drive.

Preferably, the shaft is driven by a motor, in particular a torque motor. This motor can be provided in fixed arrangement or can be jointly displaced as one with the shaft.

Should the motor be provided in fixed arrangement, a coupling, in particular a sliding coupling, is preferably provided between the shaft and the motor.

Preferably, the packaging machine has a sensor, which detects the position of the film web, for instance relative to the frame of the packaging machine or to the means of conveyance of the film web. For instance, the sensor is a web edge detection means.

Preferably, the sensor controls/regulates the servo drive, which longitudinally displaces the shaft.

In addition, the object is achieved with a method for producing a packaging with a packaging machine which unwinds a bottom film web from a supply roll and conveys it intermittently or continuously along the packaging machine and herein preferably, in a forming station, forms into the bottom film web packaging cavities, which are then filled with a product to be packaged, wherein subsequently, in a sealing station, a top film web is sealed to the bottom film web, and the bottom and top film web are respectively unwound from a supply roll and the bottom and top film web are respectively tensioned by means of a dancer roll, wherein the supply roll is unwound, driven by means of a motor.

The comments made regarding this subject of the present invention apply equally to the other subjects of the present invention, and vice versa. Features which have been disclosed in relation to this subject of the present invention can be incorporated into the other subjects.

In this subject of the present invention, the unwinding of the film web is realized at least substantially by means of a motor which drives the respective supply roll rotatively, and not, as in the prior art, by a movement of conveyor chains which convey the bottom film web along the packaging machine, or by means of the bottom film web to which the top film is sealed. Nor, according to the present invention, is a supporting of the unwinding movement sufficient. The motor preferably also acts as a brake in order to avoid an unwanted unwinding of the film web from the supply roll.

Preferably, the supply roll is unwound, at least substantially, in accordance with a feed rate of the bottom film web. For this, data concerning the initial draw length and/or the speed profile of the feed are available to a control system. The rotation speed of the supply roll is set accordingly. Since the drive of the supply roll is preferably a torque motor with a very large torque, the drive can accordingly also respond dynamically to an indexed drive.

Preferably, the parameters of the motor which drives the respective supply roll, in particular the rotation speed, the number of increments through which the power take-off shaft of the motor is intended to rotate, and/or the torque, are set on the basis of the parameters of the supply roll, in particular the weight and/or the diameter thereof, wherein preferably the respectively current weight or the respectively current diameter of the supply roll, which diameter changes upon the initial draw, is taken into account. Particularly preferably, at least when the film is changed, the diameter and/or weight of the supply roll is determined automatically or inputted into the control/regulating system of the packaging machine.

Preferably, the dancer roll has a movement transducer, in particular a rotary encoder. On the basis of the signal of the movement transducer and on the basis of the incremental encoder of the motor which drives the supply roll, the original or initial or current diameter of the film roll can be determined. Preferably, the signal of the movement transducer is used to regulate/control the motor, for instance in that the torque, the rotation speed and/or the turning length of the power take-off shaft of the motor which drives the supply roll is calculated and the motor controlled/regulated accordingly.

Preferably, at least during the automatic unwinding of the supply roll, a deviation of the actual position from the target position of the dancer roll system is registered and, from this, a correction value to the previously calculated unwinding speed/torque is determined and taken into account. As a result, in the event of an undesirably high deviation of the position of the dancer roll from the desired position, the drive of the supply roll can be accelerated or reduced in order that the dancer roll makes its way back into the desired target position.

Preferably, the nominal width of the films is inputted or read out automatically.

According to another preferred embodiment of the present invention, the original supply roll parameters are drawn from a database and/or a data carrier. For instance, in the database can be contained the film width, the supply roll weight, the supply roll diameter, the length of the film web, and/or the internal and/or external diameter of the core. The data can be arranged, for instance, on a data carrier disposed on the supply roll, for instance a transponder. The supply roll can also, however, have an identification means, for instance a barcode or QR code, on the basis of which the data can be retrieved from a database.

Preferably, on the basis of the parameters of the supply roll and/or a registered unwinding history, the residual length of the film web is determined. On the basis of this known residual length, the approaching film end can, for instance, be indicated to the operator and/or can initiate an automated film change.

A further subject of the present invention is a method in which a bottom film web unwinds from a supply roll and conveys intermittently or continuously along the packaging machine and herein, where appropriate, in a forming station, forms into the bottom film web packaging cavities, which are then filled with a product to be packaged, wherein subsequently, in a sealing station, a top film web is sealed to the bottom film web, wherein the bottom and top film web are respectively unwound from a supply roll and the supply roll is rotatably mounted on a shaft, wherein, as a result of the rotation, a film web is unwound in a running direction, and in which the shaft is displaced along its longitudinal center axis.

The comments made regarding this subject of the present invention apply equally to the other subjects of the present invention, and vice versa. Features which have been disclosed regarding this subject of the present invention can be incorporated into the other subjects.

BRIEF DESCRIPTION OF THE DRAWINGS

The inventions are explained in greater detail below with reference to FIGS. 1 to 4. These statements are merely exemplary and do not limit the general inventive concept. The statements apply equally to all subjects of the present invention.

DETAILED DESCRIPTION

Figure 1:
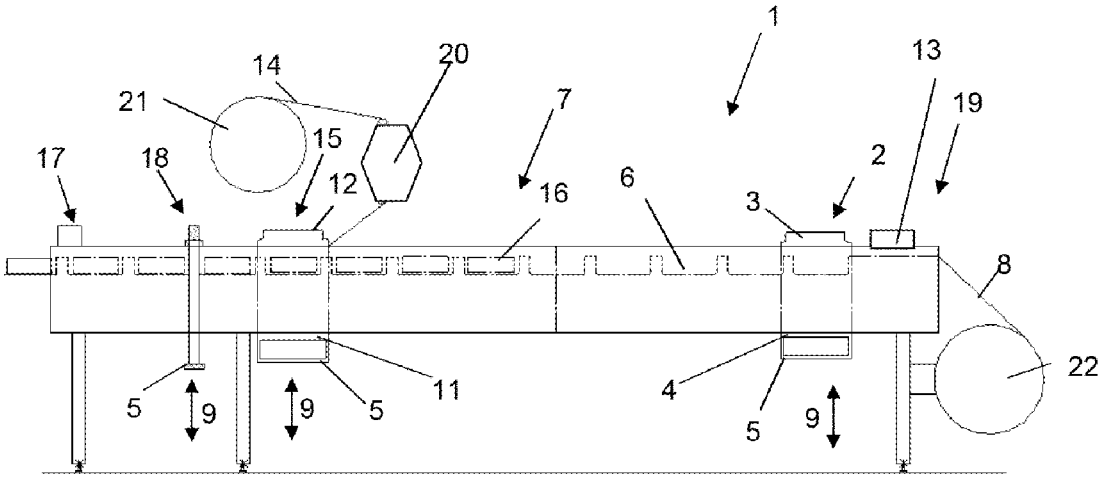
FIG. 1 shows the packaging machine according to the invention.

FIG. 1 shows the packaging machine 1 according to the invention, which has a deep-drawing station 2, a filling station 7 and a sealing station 15. A bottom film web 8, here a plastics film web 8, is drawn off from a supply roll 22 and conveyed in cycles along the packaging machine according to the invention from right to left. In the course of a cycle, the bottom film web 8 is advanced by a format length/feed length. For this, the packaging machine has two conveying means (not represented), in the present case respectively two endless chains, which are arranged to the right and left of the bottom film web 8. Both at the start and at the end of the packaging machine, for each chain there is respectively provided at least one gearwheel, around which the respective chain is deflected. At least one of these gearwheels is driven. The gearwheels in the entry region and/or in the exit region can be connected to one another, preferably by a rigid shaft. Each conveying means has a multiplicity of clamping means, which clampingly grip the bottom film web 8 in the inlet region 19 and transmit the movement of the conveying means to the bottom film web 8. In the outlet region of the packaging machine, the clamping connection between the conveying means and the bottom film web 8 is released again. Downstream of the inlet region 19 is provided a heating means 13, which warms the film web 8, in particular when this is stationary. In the deep-drawing station 2, which possesses a top tool 3 and a bottom tool 4, which has the shape of the packaging cavity which is to be produced, the packaging cavities 6 are formed into the warmed film web 8. The bottom tool 4 is arranged on a lifting table 5, which, as is symbolized by the double arrow, is vertically adjustable. Prior to each film feed, the bottom tool 4 is lowered, and afterward raised again. In the further course of the packaging machine, the packaging cavities are then in the filling station 7 filled with the product to be packaged 16. In the following sealing station 15, which likewise consists of a top tool 12 and a vertically adjustable bottom tool 11, a top film 14 is integrally fastened to the bottom film web 8 by sealing. The movement of the bottom film web 8 is thereby transmitted to the top film web 14. In the sealing station too, the top tool and/or the bottom tool, before and after each film transport, is lowered or raised. The top film 14 too can be guided in conveying means or conveyed by conveyor chains, wherein these conveying means then extend only before the sealing station and, where appropriate, downstream. Otherwise, the comments which were made regarding the conveying means of the bottom film apply. The top film too can be warmed with a heating means and deep-drawn. For the sealing, there is provided as the bottom tool 11, for instance, a heatable sealing frame, which, for each packaging cavity, has an opening into which the packaging cavity, in the course of the sealing, i.e. upon the upward movement of the bottom sealing tool, intrudes. For the sealing, the top and bottom film web are pressed together between the top and bottom tool 12, 11 and are joined under the influence of heat and pressure. After the sealing, the tools 11, 12 are moved apart again vertically. Between the supply roll 21 and the sealing tool is provided a dancer roll 20, here a rotational dancer roll, keeps the film web 14 as far as possible at a constant tension. The person skilled in the art will understand that a plurality of top films can be present, for instance in the case of a multilayer packing or a packing having a plurality of top films. Preferably, in the course of each top film, a dancer roll is then provided. The person skilled in the art will further understand that, also in the region of the bottom film, a dancer roll is preferably provided, preferably downstream of the supply roll 22. Preferably, the dancer roll is constituted by a linear dancer roll. Before and/or during the sealing of the top film to the bottom film, in each packaging cavity a gas exchange is preferably made. For this, the air present in the packaging cavity is firstly partially extracted and then replaced by an exchange gas. For this, in the region of each format holes are made in the bottom film, while in the region of the conveyor chains holes are made in the bottom film web, through which holes the air between the film webs 8, 14 is extracted and the exchange gas is then blown in. In the further course of the packaging machine, the finished packagings are separated, which in the present case is realized with the transverse cutter 18 and the longitudinal cutter 17. The transverse cutter 18 can in the present case likewise be raised or lowered with a lifting device 9.

According to the invention, at least one supply roll 21, 22 is driven by a motor, in particular a torque motor, such that the length of the respectively required feed of the respective film web is unwound from the roll without the tensile force of the two conveying means, of the conveyor chains, and/or the tensile force of the bottom film web, being significantly transmitted to the top film web. As a result, the respective film web is subjected only to a comparatively small tension and thus is not prestretched and does not crease. With the packaging machine according to the invention or with the method according to the invention, also comparatively thin film webs can be processed. No film brake for the top film web is required in order to adapt the position of the print marks on the top film to the position of the cavities in the bottom film web. The dancer roll must be designed only for very small movements or for a very small, or even no, film web storage volume.

Preferably, the rotation of the motor which drives the supply roll 21, 22 is controlled/regulated by a computer means, which can be part of the packaging machine or part of a linear control system. In particular, the rotation speed of the supply roll is controlled such that the unwound film web length corresponds to the feed, and/or such that the speed profile of the unwinding of the film web and/or of the feed of the conveying means, in particular of the conveyor chains, is at least substantially identical. The respectively current diameter or the respectively current weight of the supply roll is here taken into account.

Preferably, the dancer roll is provided with a movement transducer, for instance a rotary encoder or a linear, with which can be determined the stored film length to which the movement of the dancer roll corresponds. This information can be used, for instance, to determine the diameter of the supply roll.

Preferably, a dancer roll is provided in the region of the bottom and of the top film web. Preferably, the supply roll of the bottom film web and/or of the top film web is driven with a motor such that the unwinding of the respective film web is realized with a motor drive such that the respective film web is at most only slightly tensioned.

Figure 2:
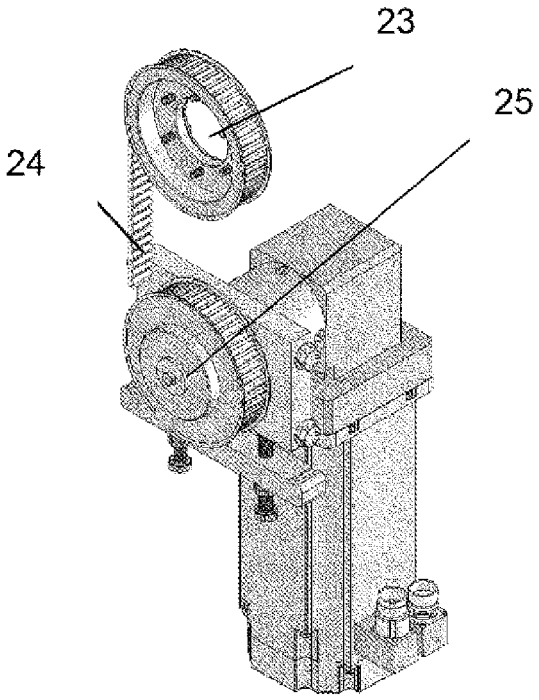
FIG. 2 shows a supply roll drive with a toothed belt.

FIG. 2 shows a first embodiment of the drive for unwinding the supply roll 21, 22. In the present case, between the motor 25, here preferably a torque motor, is connected by means of a toothed belt to the drive shaft 23 of the supply roll. The supply roll is in turn connected in a rotationally secure manner to the drive shaft 23. By this rotary drive, the rotary movement of the motor is transmitted without slippage to the shaft on which the supply roll is mounted.

Figure 3:
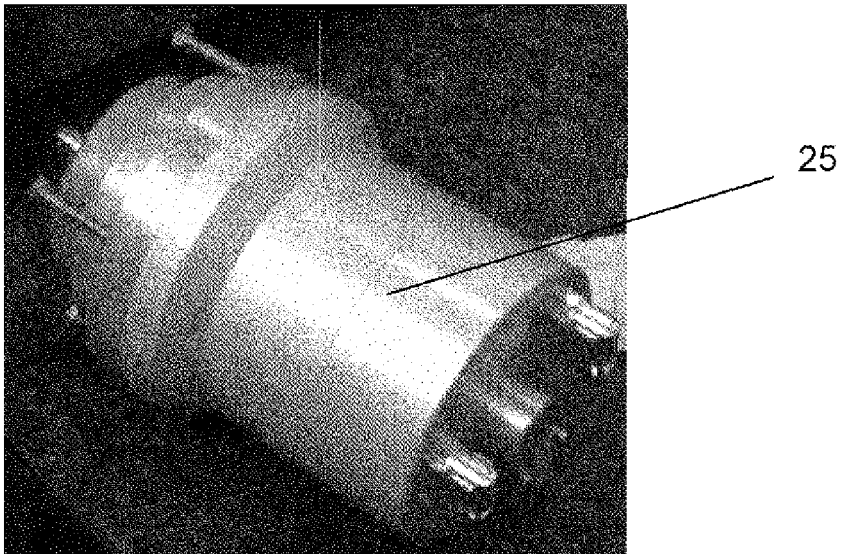
FIG. 3 shows a torque motor.

FIG. 3 shows a so-called direct drive, in which the power take-off shaft of the motor is directly connected to the rotary shaft of the supply shaft. The motor is constituted by a torque motor.

Figure 4:
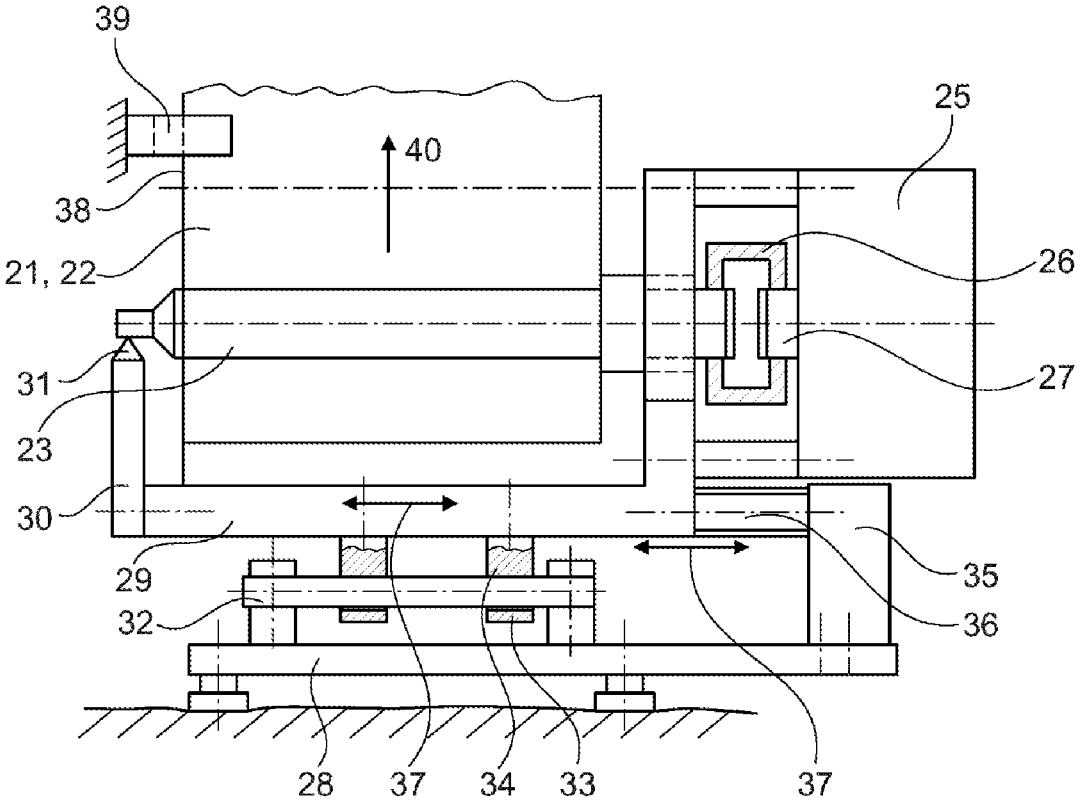
FIG. 4 shows the film unwinding facility of a packaging machine.

FIG. 4 shows a further embodiment of the packaging machine according to the invention, wherein reference can substantially be made to the comments according to FIG. 1. The supply roll 21, 22 is mounted on a shaft 23, preferably such that it is rotationally secure and/or non-axially displaceable. In the unwinding of the bottom and/or top film web 8, 14, the shaft 23 rotates in the direction indicated by the arrow 40. The shaft 23 is preferably supported in the region of its two ends, in a rotatable and, where appropriate, also longitudinal manner, by means of a bearing 31. A bearing 31 can be provided, for instance, on the housing of the film unwinding facility or of the packaging machine. For a longitudinal displacement, the bearings 31 can be realized as slide bearings. The shaft 23 is preferably rotationally driven by means of a motor 25. Between the motor 25 and the shaft 23, a coupling 26, for instance a sliding coupling or a gear, preferably a sliding gear, can be provided. According to the invention, the shaft 23 alone, and/or the frame 29 on which the shaft 23 of the film unwinding facility is mounted, is now provided such that it is longitudinally displaceable, as symbolized by the arrow 37, and/or transversely to the direction of transport 40 of the film web. For this, the frame 29, on which the shaft 23 and the motor 25 are provided, is provided, for instance, such that, it is longitudinally displaceable, for instance along a guide 32. The movement 37 is effected, for instance, by an adjustment drive 35, which moves at least the shaft 23 along its center axis, preferably, however, also the frame 29. The person skilled in the art will understand that also the drive motor 25, in the longitudinal displacement, can, but does not have to be, jointly moved. The mounting 32-34 is preferably arranged on an, in particular fixed, base frame 28.

Preferably, the packaging machine according to the invention has a sensor 39, which is preferably a web edge detection means. This web edge detection means 39 detects the position of the web edge, for instance relative to the frame of the packaging machine or to some other, preferably fixed, location. Should the web edge be located beyond a desired limit, the adjustment drive 35 is preferably activated, which then moves the shaft 23 or the frame 29 in the direction symbolized by the arrows 37 to the point where the film web is again within the desired limit.

REFERENCE SYMBOL LIST

1 packaging machine
2 forming station, deep-drawing station
3 top tool of the deep-drawing station
4 bottom tool of the deep-drawing station
5 lifting table, carrier of a tool of the sealing, deep-drawing station and/or of the cutting device
6 packaging cavity
7 first filling station
8 film web, bottom film web, material web
9 lifting device
10 drive
11 bottom tool of the sealing station
12 top tool of the sealing station
13 heating means
14 top film web, cover film, material web
15 sealing station
16 product to be packaged
17 longitudinal cutter
18 transverse cutter
19 inlet region
20 dancer roll
21 supply roll of the top film web
22 supply roll of the bottom film web
23 shaft of the supply roll
24 drive means, toothed belt
25 motor, torque motor
26 coupling, sliding coupling
27 motor shaft
28 base frame, packaging machine
29 support, displaceable frame
30 door, bearing housing, frame
31 bearing, slide bearings
32 guide, guide rod
33 bearing, slide bearings
34 bearing pedestal, bearing housing
35 adjustment drive, motor, gear motor, spindle motor, servo motor
36 spindle, shaft, adjusting means, sliding means
37 adjustment direction, sliding direction
38 web edge, film edge, material web edge
39 sensor, web edge detection means
40 direction of transport, film running direction, web running direction

The invention claimed is:

1. A packaging machine which unwinds a bottom film web from a first supply roll and conveys the bottom film web intermittently or continuously along the packaging machine, wherein the packaging machine comprises:

a forming station that forms the bottom film web into packaging cavities, which are then filled with a product to be packaged, a sealing station, wherein in the sealing station, a top film web is sealed to the bottom film web, the top film web is unwound from a second supply roll, and the bottom film web and the top film web are respectively tensioned by means of a dancer roll, wherein the first supply roll and/or the second supply roll is driven by means of a motor, and parameters of the motor, that include rotation speed and/or torque, are adjusted based on parameters of film located on and not yet unrolled from the first supply roll and/or the second supply roll when the parameters of the motor are adjusted.

2. The packaging machine as claimed in claim 1, wherein the motor is a torque motor.

3. The packaging machine as claimed in claim 1, wherein the dancer roll has a movement transducer that is a rotary encoder, and a signal of the movement transducer is used to regulate and/or control the motor.

4. The packaging machine as claimed in claim 1, wherein the torque or rotation speed of the motor is calculated and the motor is controlled/regulated to provide a film length required for a cycle or feed.

5. The packaging machine as claimed in claim 1, wherein the packaging machine comprises means to register a speed of the respective film web and/or a speed pattern during an initial draw feed, which is then stored in a control system of the packaging machine.

6. The packaging machine as claimed in claim 5, wherein the speed and the speed pattern are considered in the controlling of the motor.

7. The packaging machine as claimed in claim 1, wherein the parameters include a core diameter of the roll, a film width, a film thickness, a film length, an original and/or current weight of the supply roll, an original and/or current diameter of the supply roll, and/or a specific film weight, or a combination thereof.

8. The packaging machine as claimed in claim 1, wherein the parameters are selected from a group consisting of: a core diameter of the roll, a film width, a film thickness, a film length, an original and/or current weight of the supply roll, an original and/or current diameter of the supply roll, and a specific film weight.

9. A packaging machine which unwinds a bottom film web from a first supply roll and conveys the bottom film web intermittently or continuously along the packaging machine, the packaging machine comprises a forming station that forms the bottom film web into packaging cavities, which are then filled with a product to be packaged, wherein the packaging machine comprises a sealing station and subsequently, in the sealing station, a top film web is sealed to the bottom film web, wherein the top film web is unwound from a second supply roll, and the first supply roll and/or the second supply roll is rotatably mounted on a shaft, wherein, as a result of the rotation, the bottom film web and/or the top film web is unwound in a running direction, wherein the shaft is displaceable along a longitudinal center axis of the shaft, wherein the first supply roll is unwound, driven by means of a motor, and parameters of the motor, that include rotation speed and/or torque, are adjusted based on parameters of film located on and not yet unrolled from the first supply roll when the parameters of the motor are adjusted.

10. A method for producing a packaging with a packaging machine which unwinds a bottom film web from a first supply roll and conveys the bottom film web intermittently or continuously along the packaging machine, the packaging machine comprises a forming station that forms the bottom film web into packaging cavities, which are then filled with a product to be packaged, wherein subsequently, in a sealing station, a top film web is sealed to the bottom film web, wherein the top film web is unwound from a second supply roll and the bottom film web and top film web are respectively tensioned by means of a dancer roll, wherein the first supply roll is unwound, driven by means of a motor, and parameters of the motor, that include rotation speed and/or torque, are adjusted based on parameters of film located on and not yet unrolled from the first supply roll when the parameters of the motor are adjusted.

11. The method as claimed in claim 10, wherein the second supply roll is unwound, at least substantially, in accordance with a feed rate of the bottom film web.

12. The method as claimed in claim 10, wherein the parameters of the motor, that include rotation speed and torque, are set on a basis of the parameters of the first supply roll, which include a diameter and weight of the first supply roll.

13. The method as claimed in claim 10, wherein at least when the bottom film web is changed, a diameter and/or weight of the first supply roll are determined.

14. The method as claimed in claim 10, wherein at least during automatic unwinding of the first supply roll, a deviation of an actual position from a target position of the dancer roll is registered and, from this, a correction value to a previously calculated unwinding speed/torque is determined.

15. The method as claimed in claim 10, wherein the dancer roll has a movement transducer, that is a rotary encoder, and a signal of the movement transducer is used to regulate and/or control the motor.

16. The method as claimed in claim 10, wherein a nominal width of the bottom film web and the top film web is inputted or read out automatically.

17. The method as claimed in claim 10, wherein the parameters of the first supply roll are drawn from a database and/or a data carrier.

18. The method as claimed in claim 10, wherein, on a basis of the parameters of the first supply roll and/or a registered unwinding history, a residual length of the bottom film web is determined.

19. A method, in which a bottom film web unwinds from a first supply roll and is conveyed intermittently or continuously along a packaging machine and in a forming station is formed into packaging cavities, which are then filled with a product to be packaged, wherein subsequently, in a sealing station a top film web is sealed to the bottom film web, wherein the top film web is unwound from a second supply roll, and the first supply roll and/or the second supply roll are rotatably mounted on a shaft, wherein, as a result of the rotation, the bottom film web and/or the top film web is unwound in a running direction wherein the shaft comprises a longitudinal center axis and the shaft is displaced along the longitudinal center axis, wherein the first supply roll and/or the second supply roll is driven by means of a motor, and parameters of the motor, that include rotation speed and/or torque, are adjusted based on can be set on a basis of parameters of film located on and not yet unrolled from the first supply roll and/or the second supply roll when the parameters of the motor are adjusted.

20. The method as claimed in claim 19, wherein the shaft is driven by a motor, the shaft is supported on a frame that is connected to a guide by a slide bearing and that is longitudinally displaceable along the guide in a direction transverse to a transport direction of the top film web and/or the bottom film web, the frame is longitudinally displaceable by an adjustment drive, and wherein the packaging machine comprises a coupling between the motor and the shaft to allow the shaft and the frame to be longitudinally movable along the longitudinal center axis.

21. A method, in which a bottom film web unwinds from a first supply roll and is conveyed intermittently or continuously along a packaging machine and in a forming station is formed into packaging cavities, which are then filled with a product to be packaged, wherein subsequently, in a sealing station a top film web is sealed to the bottom film web, wherein the top film web is unwound from a second supply roll, and the first supply roll and/or the second supply roll are rotatably mounted on a shaft, wherein, as a result of the rotation, the bottom film web and/or the top film web is unwound in a running direction wherein the shaft comprises a longitudinal center axis and the shaft is displaced along the longitudinal center axis, wherein the first supply roll and/or the second supply roll is driven by means of a motor, and parameters of the motor, that include rotation speed and/or torque, are adjusted based on can be set on a basis of parameters of film located on the first supply roll and/or the second supply roll, wherein the shaft is driven by a motor, the shaft is supported on a frame that is connected to a guide by a slide bearing and that is longitudinally displaceable along the guide in a direction transverse to a transport direction of the top film web and/or the bottom film web, the frame is longitudinally displaceable by an adjustment drive, and wherein the packaging machine comprises a coupling between the motor and the shaft to allow the shaft and the frame to be longitudinally movable along the longitudinal center axis.

* * * * *